US005228854A

United States Patent [19]

Eldridge

[11] Patent Number: 5,228,854

[45] Date of Patent: Jul. 20, 1993

[54] COMBAT TRAINING SYSTEM AND METHOD

[75] Inventor: Morton T. Eldridge, Madison, Ala.

[73] Assignee: Teledyne, Inc., Los Angeles, Calif.

[21] Appl. No.: 915,616

[22] Filed: Jul. 21, 1992

[51] Int. Cl.[5] ..... F41A 33/00

[52] U.S. Cl. ..... 434/11; 434/14; 434/27; 364/423; 364/578; 455/39; 455/73; 340/988; 273/439

[58] Field of Search ..... 455/39, 73; 364/410, 364/423, 424.01, 443, 578, 452; 340/988, 973; 434/11, 14, 15, 21-23, 25, 27, 379, 111; 273/313, 316, 317, 439; 89/41.01

[56] References Cited

U.S. PATENT DOCUMENTS

| | | | |
|---|---|---|---|
| 3,689,741 | 9/1972 | Sjöberg et al. | 364/423 X |
| 3,927,480 | 12/1975 | Robertsson | 434/22 |
| 4,145,111 | 3/1979 | Hannson et al. . | |
| 4,176,468 | 12/1979 | Martz, Jr. | 434/14 |
| 4,218,834 | 8/1980 | Robertsson | 434/21 |
| 4,232,313 | 11/1980 | Fleishman . | |
| 4,308,015 | 12/1981 | Tye . | |
| 4,442,491 | 4/1984 | Olhausen, Jr. . | |
| 4,443,014 | 4/1984 | Kovit et al. | 434/14 X |
| 4,729,737 | 3/1988 | Reagan et al. . | |
| 4,797,839 | 1/1989 | Powell | 364/423 X |
| 4,899,161 | 2/1990 | Morin, Jr. et al. . | |
| 4,975,696 | 12/1990 | Salter et al. . | |
| 5,002,490 | 3/1991 | Blackstone . | |
| 5,058,023 | 10/1991 | Kozikaro | 340/988 X |

FOREIGN PATENT DOCUMENTS

| | | | |
|---|---|---|---|
| 2443810 | 1/1976 | Fed. Rep. of Germany | 434/14 |

*Primary Examiner*—Richard J. Apley
*Assistant Examiner*—Joe H. Cheng
*Attorney, Agent, or Firm*—Dickstein, Shapiro & Morin

[57] ABSTRACT

A combat training system which includes individual navigation, communications and processing pods on each aircraft or combat platform. The pods use signals from GPS satellites to determine the position of the respective aircraft. Ordnance launch information is transmitted from an attack aircraft or other weapons platform to the target aircraft or other target platform. A target platform uses a trajectory model for the specific type of ordnance for determining the trajectory and the hit or miss of the ordnance. After the mission is completed, the recorded flight data is combined in a ground computer for reconstruction, review and training reinforcement.

42 Claims, 5 Drawing Sheets

FIG. 1
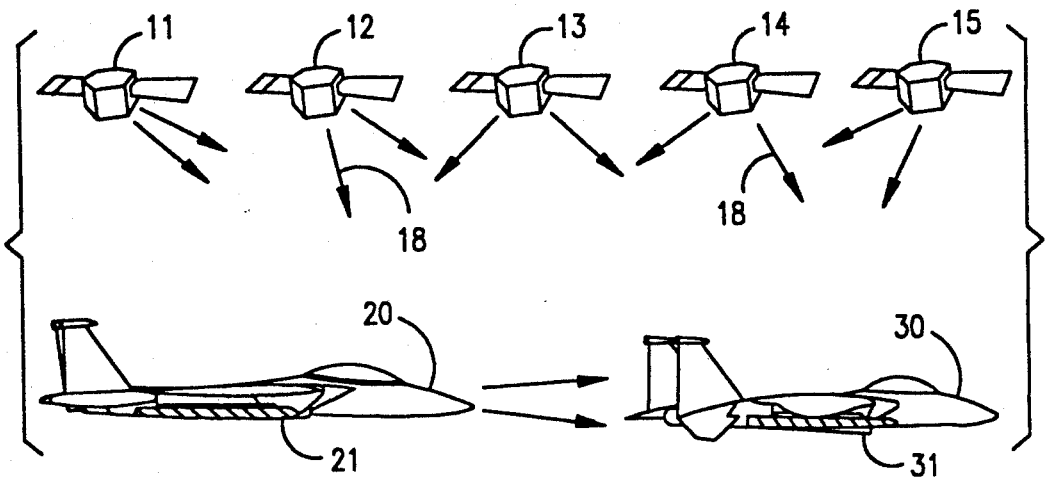
FIG. 2
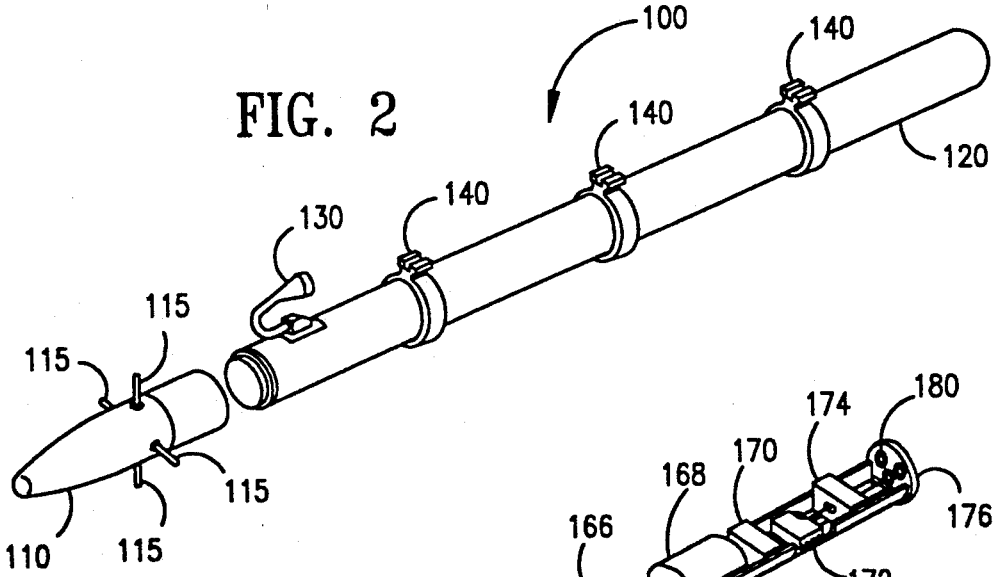
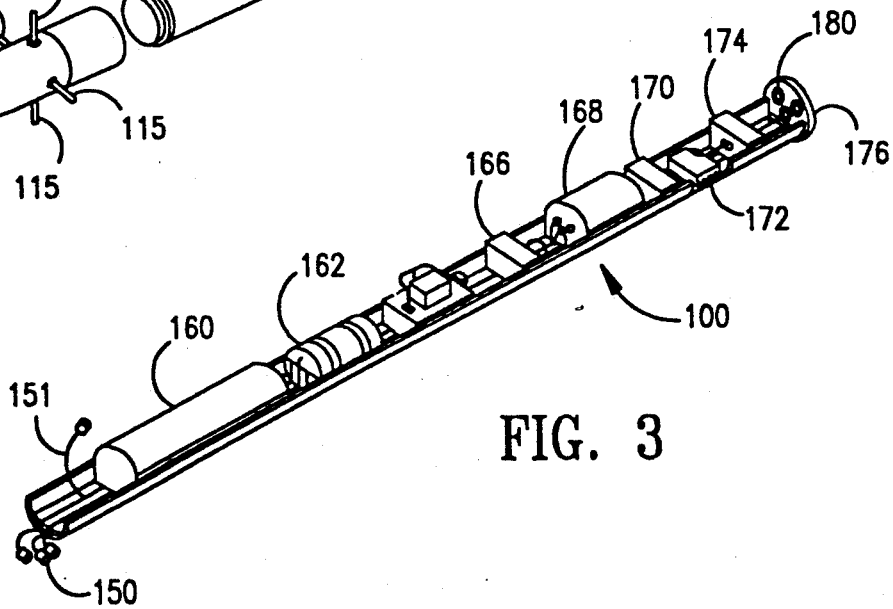
FIG. 3

COMBAT TRAINING SYSTEM AND METHOD

FIELD OF THE INVENTION

This invention relates to computer controlled combat training systems. More specifically, it relates to a distributed computer system for combat engagement training in which launch information is transmitted to the target, and the target determines ordnance hit or miss.

BACKGROUND OF THE INVENTION

Currently, the United States Air Force and Navy operate air combat maneuvering ranges at specific sites around the world. At the smaller ranges, aircraft only engage other aircraft in simulated air-to-air combat. At the larger ranges, they also are able to engage ground targets. (In addition, the Navy has at-sea (off-shore) and under-sea training ranges with complex fixed tracking infrastructures.) Simulation is accomplished by the use of dynamic flyout models of ordnance fired by the aircraft. Factored in the model is the position, orientation and velocity of the aircraft and the target at the time of simulated launch of the missile and the properties of the missile propulsion and guidance systems.

Each of these ranges includes a network of ground based transmitter/receiver sites and a central control facility. A pod on each aircraft includes equipment to provide communication with the ground based sites to provide location information and weapons deployment information. A central computer at the central control facility uses the signals received by the ground stations to determine the position of each aircraft by multilateralization techniques. Upon receipt of weapon deployment information, the central computer runs a missile model to determine whether the ordnance hit the intended target. The hit or miss information is then communicated via the ground stations back to the aircraft and the aircraft crew. The central computer can also store and later retrieve and display the data regarding the movements of the aircraft and all weapons deployments and results.

A number of disadvantages of this system result from limitations of the ground based signal transmitter/-receivers. Training is limited to specific air combat maneuvering range locations. The ranges are bounded by the transmitter/receivers and the transmitter/receivers must be located sufficiently close together to provide signals for accurate positioning of the aircraft. Therefore, the number of transmitter/receivers limits the size of the ranges. Increasing the number of transmitter/receivers, also increases the complexity and costs.

Furthermore, line-of-site requirements for signal transmission prevent use of hilly terrains for an air combat range and prevent low level flight maneuver training. Although the ground based transmitter/receivers need to be widely distributed to cover a larger flight area, they also need to communicate with the central computer and to be accessible for maintenance and repair. Therefore, areas within a maneuvering range where engagements can take place may be limited.

There is no practical way to set up maneuvering ranges far out at sea to allow for combat engagement training of Navy pilots. Even if there were, since fleet exercises occur over very large areas, such a range would necessitate a excessive number of transmitter/-receivers mounted on floating platforms. Therefore, the Navy is forced to rely on land-based or close, offshore ranges and is unable to conduct the desired air combat training when at sea.

Due to the large number of platforms, threats and engagements, a very large number of calculations are required by the central computer. It must have a large memory storage and computation capacity. The computational complexity and the number of transmitter/-receiver sites limits the number of aircraft which can be monitored. Current systems can handle about twenty to thirty-six aircraft. Present plans call for the number to be expanded to one hundred at major ranges such as the Air Force's Red Flag range and the Navy's Fallon range. This will entail a significant increase in ground stations and computer capability.

The costs of constructing and maintaining a maneuvering range are very high. A large number of widely dispersed transmitter/receivers need to be constructed and maintained. The transmitter/receivers require direct connections, through relays or land lines, to the central computer to provide the computational information. The large memory and computing needs for the central computer also increase the costs.

As a consequence of the above deficiencies, fewer ranges are available to meet desired training objectives, and the training is expensive. For widely dispersed or remotely located units, such as Air Reserve Forces or Naval Forces at sea, ranges are relatively inaccessible. When range time is available, these units must accomplish a costly deployment to the range location. For forces temporarily stationed around the world for peacekeeping missions, prewar deployments, or other reasons, all training must be suspended due to the lack of training ranges in most areas of the world.

Recently, the military has been considering a revised combat maneuvering range which would use the Global Positioning System (GPS) satellites in conjunction with an Inertial Reference Unit (IRU) for determining the position of each aircraft. The GPS is a constellation of orbiting satellites that generate signals indicative of the satellite position. Each aircraft would be fitted with a GPS receiver pod which receives signals from a number of satellites and performs its own multilateralization calculations to determine its position. A ground station would provide another GPS signal for providing the aircraft with more accurate position information with respect to the ground. The pod on each aircraft would then transmit its position to the ground based transmitter/receiver sites. Under this system, the central computer would be relieved of the position triangulation computations for the aircraft. However, it would still perform all of the other functions, and thus ranges would still be limited by the physical location of the transmitter/receiver sites (including relays), line-of-sight considerations, the computational capacity of the central computer, and high maintenance costs.

Therefore, a need exists for a air combat system that is not restricted to specific ground locations, which requires a simple, less expensive ground infrastructure, and whose operations and maintenance costs can be significantly reduced. Another need exists for a system which can be used over the ocean for training of ship-based aerial engagements. Another need exists for a system which can be used in conjunction with non-aircraft based threats such as ships, surface-to-air missiles (SAM), land-based targets (both fixed and mobile), and electronic warfare systems.

SUMMARY OF THE INVENTION

The present invention alleviates to a great extent the deficiencies of the prior art systems by performing all positioning and computational functions on the weapons systems platforms themselves. The need for the ground infrastructure is thereby eliminated.

Each aircraft or weapons system platform contains a combined navigation (GPS/IRU), communications and processing subsystem, which determines, processes, and stores all of the positional and weapons system engagement activity of that platform. The navigation, communications and processing components are carried in a pod attached to an aircraft or other weapons platform. When one platform engages another, the two platforms together become an engagement pair and determine whether the shot would have hit. Thus, no matter how many engagements occur in a major exercise, each engagement is handled by just the two participants, and each engagement becomes one element of a distributed processing system. There is no need to communicate to ground transmitter/receivers, or a central computer.

Aircraft position throughout the flight and ordnance engagement history is stored only in the pod for the platform(s) directly involved. Launch information is transmitted from a pod on an attacking aircraft to a pod on a target aircraft. The target pod aircraft uses missile models stored in memory to determine the flight trajectory of the missile and to determine whether or not the missile hit the target aircraft. After flight, the recorded information from each aircraft is transferred to a ground-based computer for combination to provide postflight reconstruction and learning reinforcement. This computer can be located anywhere since data can be transferred on ordinary telephone lines. Once the recordings are combined into an appropriate format, the scenario can be displayed wherever a display system is located.

In another aspect of the invention, pods can be included on other weapons platforms or weapons systems platforms such as ships, tanks, surface based missile deployment locations, and fixed targets such as command posts, storage depots, and bridges. The system could accommodate satellite targets of ground-based, aerial or space-based interceptors using directed energy weapons such as lasers. These pods provide for training with respect to different types of attack and defense capabilities, such that an entire diffuse array of weapons systems can engage each other in very realistic battlefield scenarios.

Therefore, it is an object of the present invention to provide a distributed on-board air combat training system which requires no ground stations. It is another object of the present invention to use small processors to perform limited tasks associated with limited memory for missile models, on each individual aircraft or weapons platform. It is another object of the present invention to provide training capabilities which are not restricted to specific geographic locations or terrains. It is another object of the present invention to use GPS satellites for positioning information. It is yet another object of the present invention to record information on each individual aircraft and later combine the information for review and training. It is another object of the present invention to simulate realistic engagements involving various weapons systems platforms. It is another object of the present invention to provide a means for postflight analysis of various maneuver training such as aerobatics, instrument flying and navigation.

With these and other objects, advantages and features of the invention that may become apparent, the nature of the invention may be more clearly understood by reference to the following detailed description of the invention, the appended claims and the several drawings attached hereto.

BRIEF DESCRIPTION OF THE DRAWINGS

FIG. 1 is a schematic representation of the basic operation of a combat training system according to a preferred embodiment of the present invention.

FIG. 2 is an exploded perspective view of a navigation, communications and processing pod according to a preferred embodiment of the present invention.

FIG. 3 is a partial cutaway view of the navigation, communications and processing pod of FIG. 2.

DETAILED DESCRIPTION OF PREFERRED EMBODIMENTS

Referring now in detail to the drawings, there is illustrated in FIG. 1 the basic elements of the present invention. The following preferred embodiments relate to air combat training ranges, which predominately use manned aerial weapons platforms - air-to-air, air-to-ground, and ground-to-air, and related simulated engagements. The concepts are equally applicable to surface-to-surface platforms, such as tanks, armored personnel carriers, or ships at sea, to infantrymen carrying surface-to-air or surface-to-surface missiles, such as Stinger and TOW, and to unmanned vehicles (robots), both aerial and ground systems. The system can even accommodate guns, using probability analysis to compensate for navigational inaccuracies. Similarly, the concept can readily accommodate both Electronic Warfare emulator inputs as well as simulated threats generated within the platform on-board processor and its memory.

Figure 10:
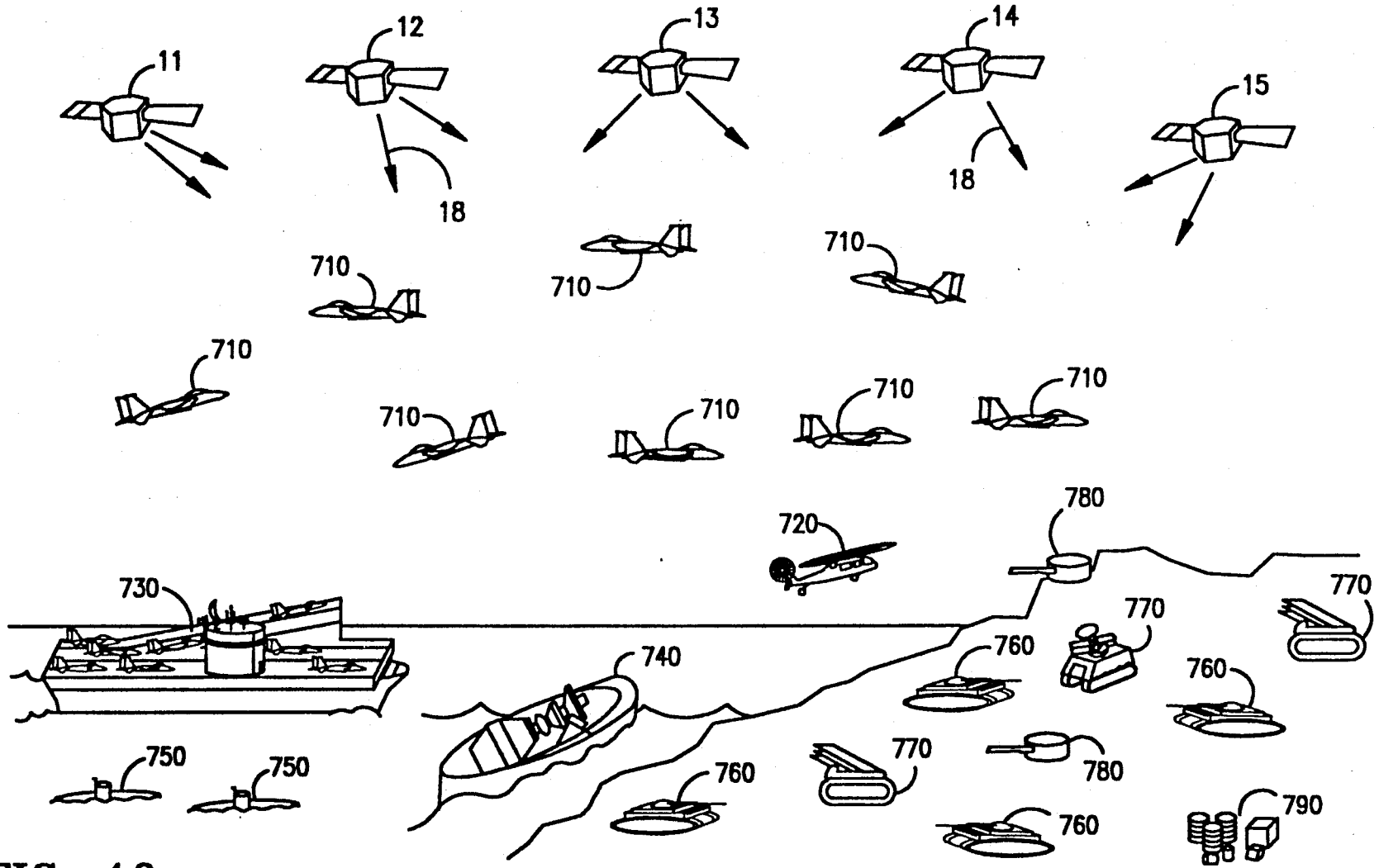
FIG. 10 is a pictorial view of the use of a preferred embodiment of the present invention with multiple weapons platforms.

A weapons system platform refers to a weapon or ordnance carrier, or to other strategic or tactical targets. As illustrated in FIG. 10, the combat system is flexible to allow for use with many different types of weapons platforms and target objectives. With respect to the present invention, weapons platforms would include aircraft (fixed wing 710, rotary wing, lighterthan-air, and helicopters 720), naval ships (aircraft carriers 730, missile cruisers 740, other surface ships, and submarines 750), ground vehicles (tanks 760, armored personnel carriers, missile systems 770, trucks, jeeps, high mobility multi-wheeled vehicles (HMMWV) and infantrymen), ground installations (command posts, artillery 780, fortifications, storage dumps 790, transportation hubs, warehouses, bridges, power stations, dams and other strategic or tactical infrastructure) and directed energy weapons (high energy lasers and satellite, not shown).

An attacking aircraft 20 and a target aircraft 30 each has a processing means or pod, respectively an attack pod 21, and a target pod 31. The processing means is the combat training system subsystem packaged in a configuration best suited to represent the different weapons systems, contained on different platforms, and to provide the necessary calculations. Although in the illustrated preferred embodiment the processing means is shown as a separate, aerodynamic, attachable pod, many other configurations are possible. The appropriate configuration would depend upon the associated weapons platform. The processing means could even be incorporated as a permanent part of the weapons platform design. Each pod 21, 31 includes equipment to receive signals 18 from GPS satellites 11, 12, 13, 14 and/or 15. The signals are used in a known way to determine through multilateralization the position of the respective aircraft. The position determined by the pod is not exact with respect to the earth, due to slight transmission delays. However, while the absolute position in relation to the earth may have ten to fifteen meter errors, the position of one platform relative to another is very accurate since each will experience the same delay or be subject to the same clock variations from the GPS satellites. The accurate relative positions of the aircraft enable calculation of the missile trajectory. The position can be determined at less than 0.01 second intervals.

The pod 21 on the attacking aircraft 20 receives ordnance launch information, such as type of ordnance, initial direction and velocity of the missile or other ordnance, and lock-on information from the fire control system, directly from the attack aircraft 20. Ordnance can be missiles, rockets, bombs or guns. The attack aircraft position and the ordnance launch information is transmitted from the attack pod 21 to the target pod 31. In addition to the ordnance information from the attack aircraft 20, the attack pod 21 determines its own three-dimensional position and attitude at the time of the launch using the GPS/IRU system, and transmits additional information relating to the orientation, altitude and velocity of the attack aircraft 20, which affects the missile trajectory.

The target pod 31 receives the transmitted position of the attack aircraft 20 and the ordnance information. Using a stored missile model for the specific type of ordnance, the target aircraft pod 31 calculates the missile trajectory compatible with the original launch conditions and the target aircraft position history from the time of launch until the missile would have passed the plane of the target. The plane of the target is defined as a plane in space including the position of the target aircraft 30, which is perpendicular to the missile direction. Therefore, the trajectory of the missile is determined through the time when it would either hit or miss the target aircraft 30. The missile trajectory would account for target aircraft maneuvers during the time of missile flight, as well as missile propellant, thrust, aerodynamics, infrared or other tracking capabilities and the like. Additionally, some missiles, such as the AIM (Air Intercept Missile) 7 and AMRAAM (Advanced Medium Range Air to Air Missile) are partially guided by the radar of the attack aircraft. For these types of ordnance, the attack pod 21 would transmit position and status of the attack aircraft after launch. The calculation of the missile trajectory would depend upon an attack position and status to provide continued illumination. If the attack aircraft turns before a hit/miss determination such that the target would not be illuminated by the radar, the missile becomes ballistic with a different trajectory model. If the computation determines that the missile would hit (kill) the target aircraft, the target aircraft pilot would be notified by enunciation in his headset, an indicator light, or other indication. Simultaneously, pod 31 would send an omnidirectional signal from antennas 115 to all other pods notifying them that target aircraft 30 was hit.

In all cases, the two aircraft or other weapons platforms involved in an engagement, or an exchange of ordnance between the two platforms, operate independently of all other platforms, except for providing information to other potential targets so as to resolve any ambiguity as to the actual target or for announcing hits. No ground support infrastructure is required during the training exercise itself. No interaction with other elements is required. Thus, the system is completely flexible and can be used for small one-on-one training or expanded to encompass entire combined arms exercises.

FIGS. 2 and 3 illustrate the design and components of a navigation, communications and processing pod 100. The nosecone 110 includes a forward-looking directional transmitter antenna (not shown) and omnidirectional transmitter/receiver antennas 115, and optionally a GPS antenna. Existing GPS antennas on the aircraft may also be used. Additional GPS antennas can be installed at various locations on the aircraft to prevent possible loss of GPS signal. The body 120 of the pod 100, which houses the processing components, includes a number of pod hangers 140 or other attaching means for attaching the pod to the missile or ordnance attachment area of the aircraft. For example, the pod could attach to a LAU 7/A launcher on the aircraft, which is used for AIM 9 missiles. Alternatively, the pod could be connected to or carried by the aircraft in any manner which would allow the pod to be in the same position as the aircraft and to receive launch information from the aircraft. A power and databus connector 130 attaches to the aircraft. Aircraft power and data from the aircraft databus, such as missile or ordnance launch information, are made available to the pod through the launcher and this connector. The connector also connects directly to the databus of the aircraft which is extended into the launcher or store interface unit to provide the missile or ordnance launch information to the pod. Ordnance firing is controlled by a fire control computer on board the aircraft. A databus in the aircraft transfers all ordnance launch information from the fire control computer to the missile launchers. Attaching the pod to the databus provides the necessary ordnance launch information directly from the fire control computer of the attack aircraft. It also provides access to radar warning receiver display information, so that the information can be recorded for postflight reconstruction and review.

Figure 4:
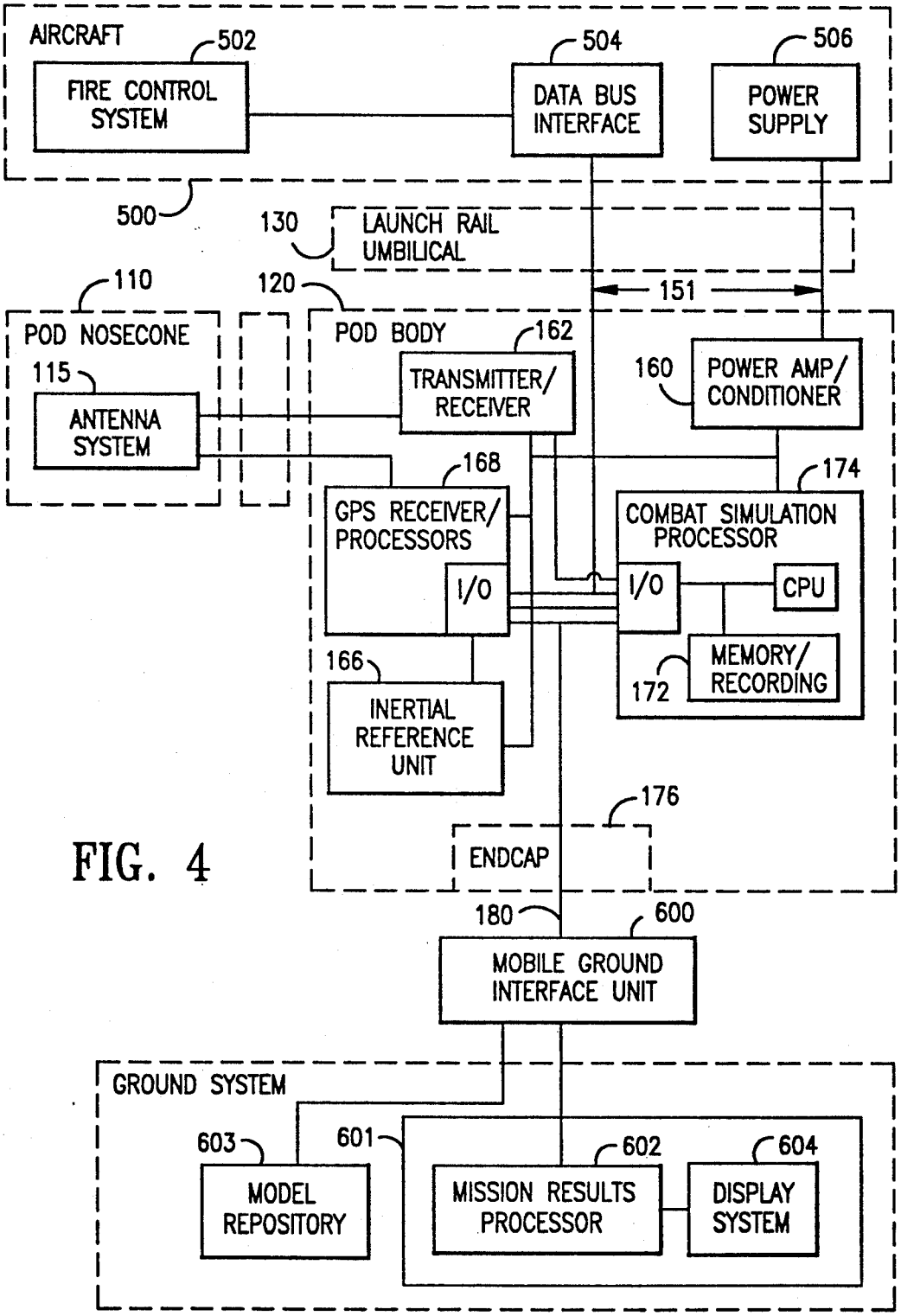
FIG. 4 is a block diagram of a combat training system according to a preferred embodiment of the present invention, including the navigation, communications and processing pod of FIG. 2.

FIG. 3 illustrates the external configuration of the pod components, and FIG. 4 illustrates the internal configuration and connections of the pod components and the other components of the air combat training system. A power amplifier 160 receives power through the power and databus connection 151 directly from the power supply 506 of the aircraft 500. A backplane (not shown) provides the power and databus connections to each of the other components in the pod. The power amplifier 160 provides power to all equipment in the pod. A transmitter/receiver 162 constitutes a transmission means and a receiving means to provide and receive signals from the pods on the other aircraft through the antennas 115 located in the nosecone 110. The transmitter/receiver in the pod is connected to the nosecone by the antennas connectors 150. Position information is determined by the receipt of signals from GPS satellites by a position reception means including a GPS receiver 168. The GPS receiver 168 can be connected to the power amplifier 160, or, alternatively, have its own power supply 170. An inertial reference means or unit 166 provides additional information regarding the flight status of the aircraft, such as aircraft attitude, altitude, and velocity. The combined GPS/IRU provides position, velocity, acceleration, and attitude data to the combat simulation processor 174, which records the position in a flight recording means or memory 172. Missile or ordnance status information at launch is also recorded in the memory 172. Therefore, the processor 174 operates as a launch means, a launch status means, a target status means or a flight status means according to the position and status which are being calculated. The memory 172 also functions as a model memory means and contains the ordnance flyout or missile models to be run by the processor 174 when the aircraft is considered the target aircraft. The end cap 176 to the pod includes connectors 180 for entering missile model data into the memory 172 or for retrieving the flight data from the memory.

After completion of the training flight, the recorded flight information is transferred, through the connectors 180 of each pod, from the memory 172 of each aircraft to a ground computer 601 to be combined for later display by a debriefing system. The transferring means to transfer the data could be a direct connection to the ground computer 601 or, preferably, a mobile ground interface unit 600, which includes a small computer with a large memory. The mobile ground interface unit 600 can write to and read from the pod memory and the central storage medium or model repository 603, which holds the various threat models. The interface unit 600 has a storage medium which could be a tape, a solid state device, a magnetic disk, or any other appropriate medium to store data. Thus, it is able to transfer data from the missile repository 603 to a pod and from a pod to a mission results computer 602. The ground computer or display and debriefing system 601 includes a mission results computer 602 with several large integrated screen displays 604. It operates in the same manner as current systems for engagement reconstruction and review. The display and debriefing system 601 includes a combining means to combine data from each pod and a display means to convert the recorded flight data from each of the mission aircraft into integrated three-dimensional and various aspect two-dimensional displays to reconstruct the mission. The reconstruction can be used for mission review, training and critique. The information can also be used later for tactical review.

The system can also be used for nonengagement flight training, such as low level reconnaissance, aerobatics, or instrument practice. The recorded position and status of the plane during maneuvers can be used to review any flight. Errors in maneuvers can be determined after flight without an observer in the aircraft. In the illustrated embodiment of FIG. 1, the pods 21 and 31 are identical and include stations to serve both as attack and target pods. However, different pods could be used for attacking or target platforms, to represent different weapons systems.

Figure 5:
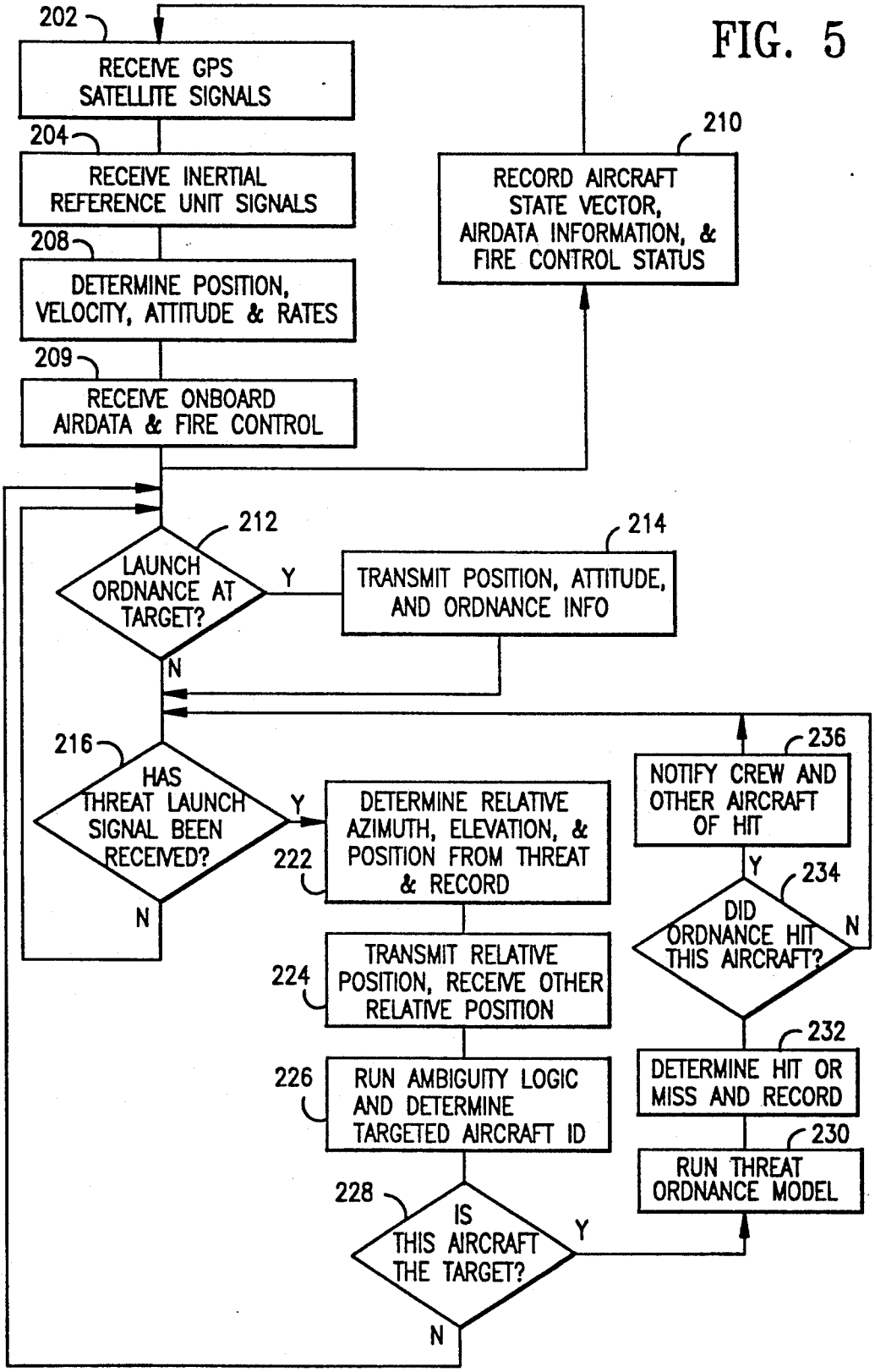
FIG. 5 is a block flow diagram of the operation of the communications and processing pod of FIG. 2.

FIG. 5 is a block flow diagram illustrating operation of a system which can operate as both an attack and target pod. At step 202, the GPS receiver 168 receives the GPS satellite signals. The signal information is combined with the outputs from the IRU in the GPS/IRU processor at step 204. The combined GPS/IRU provides position, velocity, acceleration, and attitude data to the combat simulation processor 174 at step 208. The velocity, acceleration, attitude and other orienting data are referred to as the status of the aircraft. Simultaneously, the processor 174 receives air data (optional) and fire control information from the aircraft at step 209. The position and status are recorded at step 210 in the computer memory 172. The position and status are recorded at regular time intervals so that the flight can be recreated for postflight evaluation and training. In the preferred embodiment, the position and status are recorded at one second intervals, during non-engagement flight and at a faster rate when an ordnance model is tracking a flyout. Determining and recording position and status information and fire control status, steps 202 through 210 occur continuously. Simultaneously, ordnance launch determinations and flyout calculations, steps 212 through 236, are performed when necessary.

At step 212, the processor operates as a launch means to determine whether the aircraft has launched a missile or other ordnance. Ordnance launch information is received via the databus connector 130 directly from the databus 504 of the airplane 500. Ordnance launch information would include the fire signal, the initial missile velocity vector, the relative position of a target locked up by the fire control system 502, the relative azimuth and elevation of an infrared (IR) seeker, and the kind or type of ordnance fired. The time of firing, determined by the pod processor, is accurate to 0.01 seconds to provide sufficient accuracy for calculation of the missile trajectory. All of the above information is recorded in the memory 172, which operates as a launch recording means, at the time of launch, at step 210. Additionally, the position, status and ordnance information is also transmitted on the forward-directional antenna of the pod, at step 214. After the ordnance launch information is transmitted, the pod resumes determining position and status and recording them.

If distinct attack and target pods were to be used, the attack pod would include components and programming to accomplish steps 202 through 214. The target pod would omit the components and programing steps corresponding to steps 212 and 214 and step 216 would directly follow step 209.

At step 216, the pod processor determines whether a signal has been received by the transmitter/receiver 162, operating as an attack reception means, indicating a launch from another aircraft. If a signal is received, the pod uses the position, status and ordnance information transmitted from the attacking aircraft in conjunction with its own position and status to determine its distance from the attacking platform and whether it is in the zone of engagement of the ordnance and its distance from the attacking aircraft, at step 222. The zone of engagement defines an area wherein the anticipated target would be. The zone is determined by the initial ordnance launch conditions, including position and direction.

Since the training system is intended for use with large numbers of weapons platforms, a procedure is required for resolving ambiguities regarding which one of several possible platforms is the intended target. Each pod which is within the zone of engagement transmits its calculated distance and an identifier, such as a tail number, on the omnidirectional antennas. Additionally, the elevation and azimuth of the potential targets from attack aircraft can be calculated and transmitted. Each potential target receives the transmission from other potential targets and determines whether it should be the intended target based upon a set of predetermined criteria, at step 228. Various ambiguity-resolution logic discriminators can be used and/or combined to provide the relevant criteria. Discriminators could include (1) the target that meets or is closest to the lockup position of the attacker, (2) the target closest to the center line of the seeker of a IR missile, (3) the target closest to the attacker, or (4) an order of priority based upon the identifiers. If the aircraft is not the target, the pod simply continues determining and recording the position and status of the aircraft.

If the aircraft is determined to be the target, the missile or trajectory model stored in the memory 172 for the specific type of ordnance is run on the processor 174 or other flight path means to determine the missile trajectory, at step 230. The missile model is dependent upon the missile position and the maneuvering of the target aircraft from the time of firing until it reaches the plane of the target aircraft. While the model is being run, the processor continues to determine and record the position and status of the aircraft. Optionally, the calculated position and status of the missile can also be recorded. The missile trajectory is calculated until it either hits the aircraft or passes the plane of the aircraft without hitting it. The processor 174 or other hit determining means determines whether the missile hit or missed the target aircraft, at step 232. A hit may be recorded if the missile comes close enough so that proximity fused warheads would have caused significant damage. A probability of kill ($P_k$) statistical model could be used to determine when the missile is close enough for a hit. The hit or miss determination is also recorded at step 232. If a hit occurred, the crew of the target aircraft is notified of the hit either through a headset or on a head-up display, at step 236. A target aircraft which has been hit would be expected to leave the training area and to indicate to the other players that he was out of play. This indication can be made by extending speed breaks, rocking wings or making a hard right or left turn. The hit determination could also be transmitted at step 236 on the omnidirectional antenna 115 so that all aircraft, including the attacking aircraft, know the result of the engagement. Pyrotechnic charges or strobes could be included on each pod or launch rail to release a smoke puff and/or light flash for a visual hit indication. Similarly, smoke puffs or light flashes could be used to provide indications of missile launches. Each pod would require pyrotechnic/strobe charges sufficient to provide smoke puffs for each missile fired as well as one for being hit.

FIGS. 6–9 illustrate other variations of the system. The system can be used with ground and ship based ordnance. By including pods on diverse platforms such as ground installations, ships, tanks or surface-to-air missile locations, the system can be used to provide training with respect to air attacks of ground vehicles and other assets, and with respect to ground-based attacks of aircraft. The system could even be used for surface-to-surface engagements between ground forces and/or naval forces.

Figure 6:
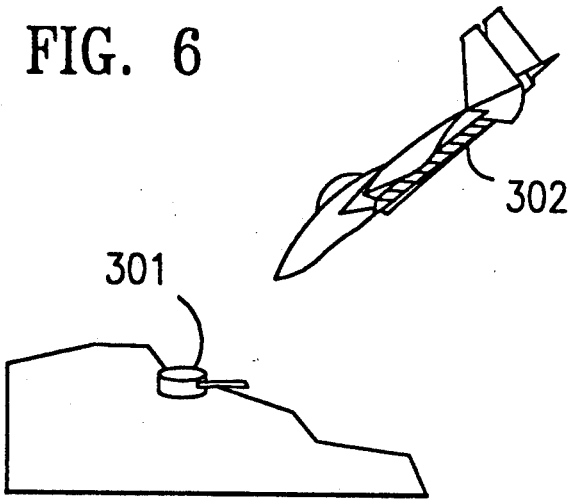
FIG. 6 is a pictorial view of the use of a preferred embodiment of the present invention with ground based targets.

FIG. 6 illustrates an air attack on a ground target 301. The system can be used for no-drop scoring, which simulates either guided missiles, guns, or unguided ordnance fired at a ground target. The ground target 301 receives the ordnance launch transmission from the attacking aircraft 302. The ground target can then maneuver or deploy defensive counter measures to avoid a missile hit. Additionally, ballistic ordnance could be simulated by including the ballistic data in the target pod. With air to ground ballistic engagements, wind affects the trajectory of the ordnance. Therefore, launch information would include a estimation of wind velocity. Normally, two thirds of wind velocity at the time of release is used as a bombing standard.

Figure 7:
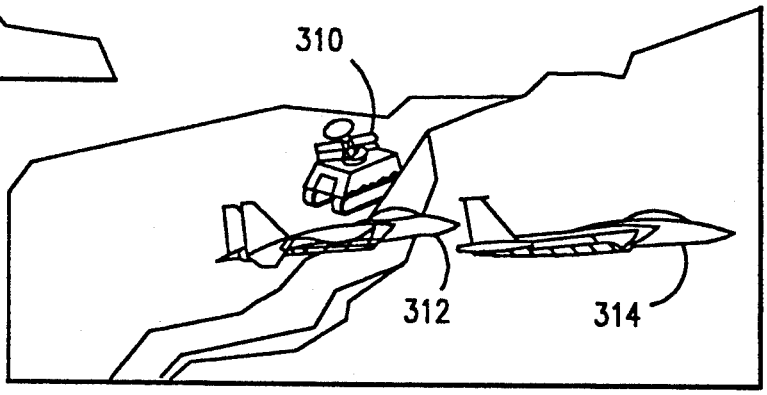
FIG. 7 is a pictorial view of the use of a preferred embodiment of the present invention with ground based attacks on aircraft.

FIG. 7 illustrates a ground based threat such as a surface-to-air missile launcher 310. The ground threat 310 would then provide the launch information and the aircraft 312, 314 would be the targets. As with aerial combat, both aircraft and ground threats can be attackers or targets for each other.

Figure 8:
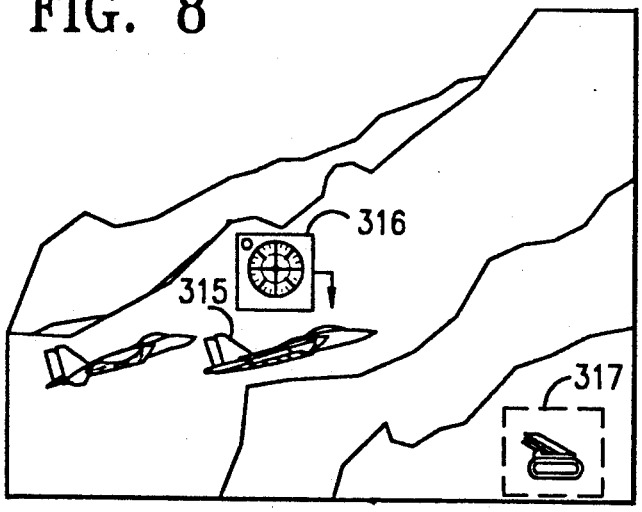
FIG. 8 is a pictorial view of the use of the preferred embodiment of the present invention incorporating simulated threats and terrain masking.

With reference to FIG. 8, the system can also be combined with an On-Board Electronic Warfare System (OBEWS) 316, which is located on the aircraft 315, to simulate additional ground threats and practice avoidance/defeat procedures. OBEWS simulates fixed SAM locations 317 and the use of terrain for avoidance procedures. The system includes data regarding terrain and threat launch procedures. When the system determines that the aircraft is within the threat line of sight and certain launch conditions are satisfied, a launch occurs. The pod can receive launch information via the databus from the OBEWS on the aircraft. The pod then calculates missile trajectory as with any launch signal.

Figure 9:
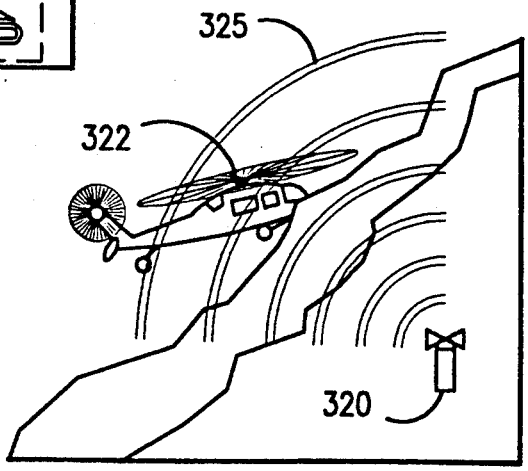
FIG. 9 is a pictorial view of the use of a preferred embodiment of the present invention with the ALERTS system representing stationary ground based threats.

Since helicopters have very precise nap of the earth flying capabilities, ground positional accuracy is more significant for simulated electronic warfare operations than it is for airplanes. FIG. 9 depicts how ground based transmitters or ALERTS 320 can be used to provide more accurate masking information. ALERTS 320 provide signal transmissions 325 so the pod can determine precisely when the aircraft 322 is in view of the ground-based threat. Similar to OBEWS, once certain conditions are met regarding line-of-sight locations, a launch is determined to occur. The missile trajectories are then run. Emulators can also be used with the system. Emulators transmit the signals which would be received by the aircraft if an actual threat of a certain type were located at the emulator position. When a launch type signal is received, the pod would execute the missile trajectory calculations for the type of threat.

Naturally, various threats can be combined for more realistic training. Therefore, a mission can include fixed and mobile SAM locations, enemy aircraft and mission targets. Each of the elements is separately operated according to pod operation. After a mission, the data is combined for complete review.

FIG. 10 illustrates the use of a preferred embodiment of the large scale engagements with multiple weapons platforms. Each weapons platform includes a pod or other processing means in an appropriate configuration. The pod on each platform receives the signals 18 from the GPS satellites 11, 12, 13, 14 and 16. Despite the large number of platforms, each engagement principally involves only two platforms, the attacking and target platforms. Only the actual target, as determined by the ambiguity resolution discriminators, needs to calculate the trajectory of each missile launched.

Although preferred embodiments are specifically illustrated and described herein, it will be appreciated that modifications and variations of the present invention are covered by the above teachings and within the purview of the appended claims without departing from the spirit and intended scope of the invention.

What is claimed as new and desired to be protected by Letters Patent of the United States is:

1. A combat training system, comprising:

a first processing means associated with a first weapons platform, said first processing means including launch means for determining ordnance information and a launch time at which at least one type of ordnance is launched from said first weapons platform, launch status means for determining a launch position and a launch status of said first weapons platform, and transmission means for transmitting said launch position, said launch status and said ordnance information; and a second processing means associated with a second weapons platform, said second processing means including model memory means for storing a trajectory model for at least said one type of ordnance of said first weapons platform, target status means for determining target position and target status of said second weapons platform, receiving means for receiving said transmitted launch position, said launch status and said ordnance information of said first weapons platform, flight path means for calculating a flight path for said ordnance of said first weapons platform based upon said launch position, said launch status and said ordnance information of said first weapons platform, said target position and said target status of said second weapons platform, and said stored trajectory model for said ordnance of said first weapons platform, and hit determining means for determining whether said ordnance of said first weapons platform would hit said second weapons platform.

2. A combat training system as in claim 1, wherein said first processing means includes path status means for determining a path position and a path status of said first weapons platform, path recording means for recording said path position and path status, and launch recording means for recording said launch position, said launch status, and said ordnance information; and wherein said second processing means includes recording means for recording said target position and target status.

3. The combat training system of claim 1, wherein said second processing means includes recording means for recording the flight path of said ordnance of said first weapons platform.

4. A combat training system as in claim 2, wherein said path position and said path status of said first weapons platform, and said target position and said target status of said second weapons platform are determined and recorded at predetermined time intervals.

5. The combat training system of claim 2, further comprising:

a ground processor;

first transferring means for transferring said recorded path position, path status, launch position, launch status, and ordnance information of said first weapons platform to said ground processor as first data; and second transferring means for transferring said recorded target position and target status of said second weapons platform to said ground processor as second data;

said ground processor including combining means for combining said first and second data, and display means for simultaneously displaying movement of said first weapons platform, said second weapons platform and said ordnance based upon said combined first and second data.

6. A combat training system as in claim 1, wherein said first weapons platform is an airplane.

7. A combat training system as in claim 1, wherein said second weapons platform is an airplane.

8. A combat training system as in claim 1, wherein said first processing means includes post launch means for determining a post launch position and a post launch status of said first weapons platform, and post launch transmission means for transmitting said post launch position and said post launch status, wherein said second processing means includes post launch receiving means for receiving said transmitted post launch position and post launch status, and wherein said flight path calculated by said flight path means of said second processing means is further based upon said post launch position and said post launch status.

9. A combat training system as in claim 1, wherein said second processing means further includes launch means for determining ordnance information and a launch time at which at least one type of ordnance is launched from said second weapons platform;

launch status means for determining a launch position and a launch status of said second weapons platform;

transmission means for transmitting said launch position, said launch status, and said ordnance information;

wherein said first processing means further includes model memory means for storing a trajectory model for at least one said type of ordnance of said second weapons platform;

target status means for determining target position and target status of said first weapons platform;

receiving means for receiving said transmitted launch position, said launch status, and said ordnance information of said second weapons platform, flight path means for calculating a flight path for said ordnance of said second weapons platform based upon said launch position, said launch status and said ordnance information of said second weapons platform, said target position and said target status of said first weapons platform, and said stored trajectory model for said ordnance of said second weapons platform; and hit determining means for determining whether said ordnance of said second weapons platform would hit said first weapons platform.

10. A combat training system as in claim 1, wherein said first and second processing means each includes position reception means for receiving positioning signals from Global Positioning System satellites, wherein said launch status means of said first processing means determines said launch position based upon said positioning signals, and wherein said target status means of said second processing means determines said target position based upon said positioning signals.

11. A combat training system as in claim 10, wherein said first and said second processing means each further comprise inertial reference means for respectively determining said launch status and said target status.

12. A combat training system as in claim 1 wherein said first processing means is associated with said first weapons platform by being attached to it.

13. A combat training system as in claim 1 wherein said second processing means is associated with said second weapons platform by being attached to it.

14. A combat training system as in claim 1, wherein said first processing means is housed in a pod.

15. A combat training system as in claim 1, wherein said second processing means is housed in a pod.

16. A combat training system for use with a plurality of weapons platform, comprising a plurality of processing means respectively associated with said plurality of weapons platforms, each of said processing means including:

model memory means for storing a trajectory model for at least one type of ordnance;

status means for determining a path position and path status of said respective weapons platform;

path recording means for recording said path position and said path status of said respective weapons platform;

launch means for determining when said ordnance is launched from said respective weapons platform, launch ordnance information regarding said launched ordnance, a launch position and a launch status of said respective weapons platform;

launch recording means for recording said launch position, said launch status, and said ordnance information;

transmission means for transmitting said launch position, said launch status and said ordnance information;

attack reception means for receiving an attack position, an attack status and attack ordnance information transmitted from another weapons platform;

flight path means for calculating a flight path for said attack ordnance based upon said attack position, said attack status and said attack ordnance information of said another weapons platform, and a stored trajectory model for said attack ordnance; and hit determining means for determining whether said launched ordnance would hit said respective weapons platform.

17. The combat system of claim 16, wherein each processing means further includes location determining means for determining a first location relative to said attack position;

location transmission means for transmitting said first location;

location reception means for receiving at least one second location of at least one other weapons platform; and ambiguity resolution means for determining whether said respective weapons platform is a target based upon said first location and said at least one second location; and wherein said flight path means calculates said flight path only if said respective weapons platform is a target.

18. The combat system of claim 16, further comprising:

a ground processor for postflight reconstruction;

transferring means for transferring said path position, said path status, said launch position, said launch status and said launch ordnance information from each of said plurality of weapons platform to said ground processor;

said ground processor including combining means for combining said information rom each of said plurality of plurality of weapons platforms, and display means for simultaneously displaying movement of said plurality of weapons platforms and ordnance based upon said combined information.

19. A combat training system according to claim 16, wherein each processing means further comprises position reception means for receiving positioning signals from Global Positioning System satellites, and wherein said status means determines said path position based upon said positioning signals.

20. A combat training system according to claim 19, wherein said status means includes inertial reference means for determining said path status.

21. A combat training system according to claim 16, wherein at least one of said weapons platforms is an aircraft.

22. A combat training system according to claim 16, wherein at least one of said weapons platforms is a water surface ship.

23. A combat training system according to claim 16, wherein at least one of said weapons platforms is a submarine.

24. A combat training system according to claim 16, wherein at least one of said weapons platforms is a ground weapons platform.

25. A combat training system according to claim 24, wherein at least one of said weapons platforms is a tank.

26. A combat training system according to claim 16, wherein at least one of said weapons platforms is a logistics vehicle.

27. A combat training system according to claim 16, wherein at least one of said weapons platforms is a fixed installation.

28. A combat training system according to claim 16, wherein at least one of said weapons platforms is a satellite engaged by a directed energy weapon.

29. A combat training system according to claim 16, further comprising:

a storage device for storing a trajectory model for each a plurality of types of ordnance; and model transferring means for transferring a trajectory model for at least one type of ordnance from said storage device to said model memory means of at least one of said processing means.

30. A processing means for use in association with a respective one of a plurality of weapons platforms in a combat system, said processing means comprising:

model memory means for storing a trajectory model for at least one type of ordnance;

path status means for determining a path position and a path status of said respective weapons platform;

launch means for determining when said ordnance is launched from said weapons platform, and for determining a launch position, a launch status and launch ordnance information of said respective weapons platform;

transmission means for transmitting said launch position, said launch status, and said launch ordnance information of said respective weapons platform;

attack reception means for receiving an attack position, an attack status and an attack ordnance information of an attack ordnance from another weapons platform;

flight path means for calculating a flight path for said attack ordnance based upon said attack position, said attack status, said attack ordnance information and a stored trajectory model for said attack ordnance; and hit determining means for determining whether said attack ordnance would hit said respective weapons platform.

31. A processing means according to claim 30, further comprising:

location determining means for determining a first location relative to said attack position;

location transmission means for transmitting said first location;

location reception means for receiving at least one second location of at least one of said plurality of weapons platform; and ambiguity resolution means for determining whether said respective weapons platform is a target based upon said first location and said at least one second location; and wherein said flight path means calculates said flight path only if said respective weapons platform is a target.

32. A processing means according to claim 30, further comprising means for attaching said processing means to said weapons platform.

33. A processing means according to claim 30, wherein said processing means is housed in a pod.

34. A processing means according to claim 30, further comprising:

recording means for recording said path position, said path status, said launch position, said launch status and said launch ordnance information.

35. A processing means according to claim 30, further comprising position reception means for receiving positioning signals from Global Positioning System satellites, and wherein said path status means determines said path position based upon said positioning signals.

36. A processing means according to claim 35, wherein said flight status means includes inertial reference means for determining said path status.

37. A processing means according to claim 30, wherein said attack position, said attack status and said attack ordnance information is generated by an On-Board Electronic Warfare System.

38. A processing means according to claim 37, further comprising alert means for receiving an alert location signal indicating the position of said another weapons platform in connection with said On-Board Electronic Warfare System.

39. A method for operating a processing means for use in association with a respective one of a plurality of weapons platforms in a combat training system, said method comprising the steps of:

storing a trajectory model for at least one type of ordnance;

determining a path position and a path status of said respective weapons platform;

determining when said ordnance is launched from said respective weapons platform, and determining a launch position, a launch status and launch ordnance information of said respective weapons platform;

transmitting said launch position, said launch status, and said launch ordnance information of said respective weapons platform;

receiving an attack position, an attack status and attack ordnance information of an attack ordnance from another weapons platform;

calculating a flight path of said attack ordnance based upon said attack position, said attack status, said attack ordnance information, and a stored trajectory model for said attack ordnance; and determining whether said attack ordnance would hit said respective weapons platform.

40. The method for operating a processing device according to claim 39, further comprising the step of:

recording said path position, said path status, said launch position, said launch status and said launch ordnance information.

41. The method for operating a processing device according to claim 39, further comprising the step of receiving positioning signals from Global Positioning System satellites, and wherein said path position and said launch position are determined based upon said positioning signals.

42. The method for operating a processing device according to claim 39, wherein said path status is determined based upon signals from an inertial reference means.

* * * * *